US005114374A

United States Patent [19]

Estiva

[11] Patent Number: 5,114,374

[45] Date of Patent: May 19, 1992

[54] DECORATIVE RING FOR BABY BOTTLE WHICH ATTACHES IN GROVE OF NIPPLE

[76] Inventor: Lynda H. Estiva, 2044 Cypress Ave., San Pablo, Calif. 94806

[21] Appl. No.: 693,000

[22] Filed: Apr. 29, 1991

[51] Int. Cl.[5] ..... A63H 33/00; A61J 9/00; A61J 9/08; B65D 39/00

[52] U.S. Cl. ..... 446/77; 446/227; 215/11.1; 215/11.6; 215/230

[58] Field of Search ..... 446/73, 74, 77, 227, 446/901; 215/11.1, 11.6, 228, 230

[56] References Cited

U.S. PATENT DOCUMENTS

| | | | |
|---|---|---|---|
| 1,759,568 | 5/1930 | Fervors | 215/11.1 |
| 2,084,689 | 6/1937 | Karl | 215/11.6 |
| 2,366,214 | 1/1945 | Ramaker | 215/11.1 |
| 2,744,646 | 5/1956 | Blackstone | 215/11.1 |
| 2,955,382 | 10/1960 | Boles | 446/227 |
| 3,051,341 | 8/1962 | Mead | 446/74 X |
| 3,165,219 | 1/1965 | Johnson | 446/227 X |
| 3,405,829 | 10/1968 | Siravo | 215/11.1 X |
| 4,732,291 | 3/1988 | McConnell | 220/19 |
| 4,759,139 | 7/1988 | Ricks | 40/638 |
| 4,930,645 | 6/1990 | Warehime | 446/77 X |
| 4,934,542 | 6/1990 | Clark, Jr. | 215/11.6 X |
| 4,944,704 | 7/1990 | Grace | 215/11.1 X |

FOREIGN PATENT DOCUMENTS

| | | | |
|---|---|---|---|
| 766082 | 1/1957 | United Kingdom | 215/11.6 |
| 778912 | 7/1957 | United Kingdom | 215/11.6 |

*Primary Examiner*—Robert A. Hafer
*Assistant Examiner*—D. Neal Muir

[57] ABSTRACT

An attachment for a baby bottle comprises a cap (27) with an annexed body portion (35) and a hole (29) in top of the body which fits down over a nipple (23) and snaps into, and is retained by a groove (31) in the base of the nipple. Also a flange (36) is provided which can be shaped to look like hair, ears, or other decorations (33). The body (35) can be painted to look like faces of cats, dogs, a girl, etc. In a second embodiment the flange (47) is made integral with the cap (25), and in a third embodiment, a flange-shaped ring (44) is placed over the bottle's neck and secured against a shoulder (39) by a cap (25).

5 Claims, 4 Drawing Sheets

DECORATIVE RING FOR BABY BOTTLE WHICH ATTACHES IN GROVE OF NIPPLE

BACKGROUND

1. Field of Invention

The present invention relates to baby bottles, in particular to a decorative improvement for such bottles.

2. Description of Prior Art

A baby's bottle usually is made plain, i.e., without any decoration. Plain bottles provide no attractive features, either for the baby or the mother. Thus they do not hold the baby's attention or provide anything interesting for the baby, other than the milk in the bottle. If the baby is unwilling to drink the milk due to drowsiness, the mother usually engages in some activity to keep the baby awake until all the milk has been drunk. Since the baby's hunger progressively diminishes toward the end of the drinking period, it may not get its full quota of milk if it becomes drowsy.

Some bottles have molded integral decorations which purport to show a high degree of decoration and attractiveness. However, these bottles do not cause the baby to take notice, become interested, or engage the baby's attention. Another problem is that they make the diameters of the bottles larger, sometimes too large for the babies' small hands to hold. Lastly the decorations are small and difficult to see.

Another problem is that when decorations are embossed on the outside of the bottle, similiar indentations are usually embossed or indented on the inside, creating cavities which hold congealed deposits of milk. These are very difficult to clean even, with a bottle brush.

Molded hearts have been made integral with the screw-down nipple-holding rings. However, these have been so small that they are virtually invisible to a baby, so that any decorative value is lost. Most parents mistakenly take them for handgrips, meant to assist in tighting the ring.

Another form of decoration on bottles consist of printed characters, flowers, and the like which are attached by an adhesive. These however soon wear off due to normal washing and handling of the bottle. Also, they are not positioned for the baby to see and to get amusement from.

M. Ricks, in U.S. Pat. No. 4,759,139, dated July 26, 1988, shows a bottle identification collar. This is useful in preventing bottle mix-ups where several babies are to be fed. However, as the babies grow, they learn to remove the collar and attempt to eat it. Also, these collars do not provide any way to interest or amuse a baby.

T. McConnell, in U.S. Pat. No. 4,732,291, dated Mar. 22, 1988, shows a wire cage which holds the parts of the bottle assembly for washing in a dishwasher. The problem here is that the cage prevents thorough washing. Thus further hand washing is necessary. Again, McConnell's device does not provide any way to interest or amuse a baby.

OBJECTS AND ADVANTAGES

Accordingly, several objects and advantages of the present invention are to provide a baby bottle which can interest and amuse a baby while feeding, to provide attachments which can be seen by the baby while feeding, which can be fitted quickly and easily, and which can be changed whenever desired.

Further objects and advantages are to provide attachments which can be cleaned easily, to provide an attachment which does not require any alteration to the baby's bottle, nipple or screw-down cap, and which fits on easily yet so firmly that a baby cannot remove it.

Still other objects and advantages are to provide a decoration with unlimited design possibilities and color alternatives, to provide a form of decoration which can provide musical sounds by incorporating mechanical or computerized devices on the decorative attachment to create such sounds, to provide a decoration for a baby bottle in which a rattle can be incorporated, and to provide a bottle decoration in which scenes of visual turbulence, such as sea waves and/or falling snow, can be incorporated.

Yet other objects and advantages are to provide a decorative system without sharp projections which might injure the baby. Also when the baby is finished with bottle feeding, the attachments can be used by the child as toys or teething rings and can be made in miniature for attachment to toy feeding bottles for dolls.

Another object and advantage is that one embodiment in the form of a ring can be used to create odd features with a non-matching face.

Still other objects and advantages will become apparent from a consideration of the ensuring description and accompanying drawings.

REFERENCE NUMERALS

Figure 2:
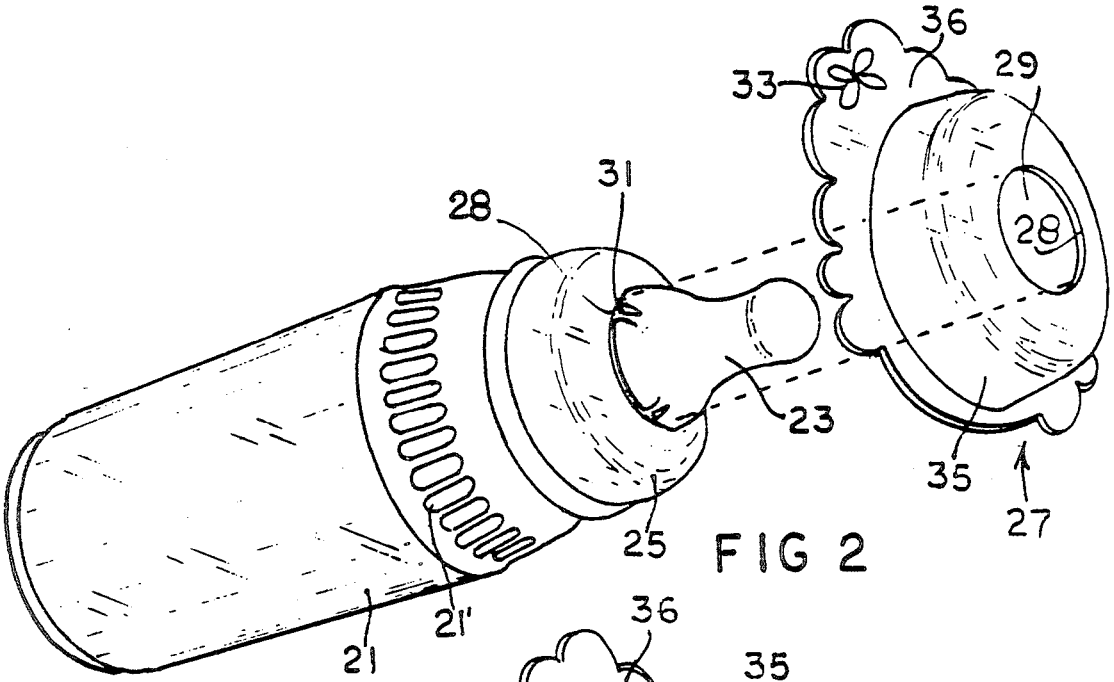
FIG. 2 is an exploded perspective view of the decorative cap cover being attached to the bottle.
Figure 1:
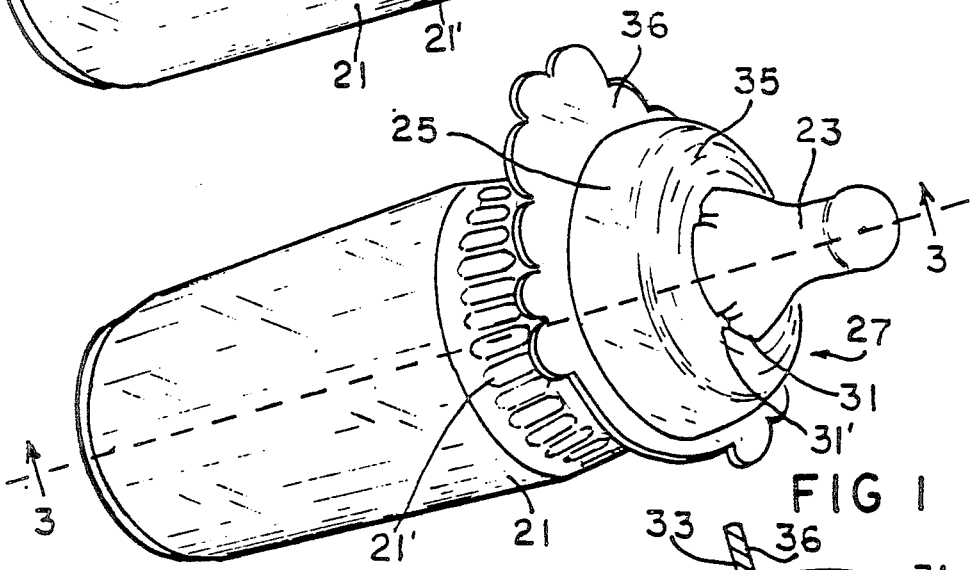
FIG. 1 is a perspective view of a baby bottle fitted with a decorative cap cover according to a first embodiment of the present invention.
Figure 3:
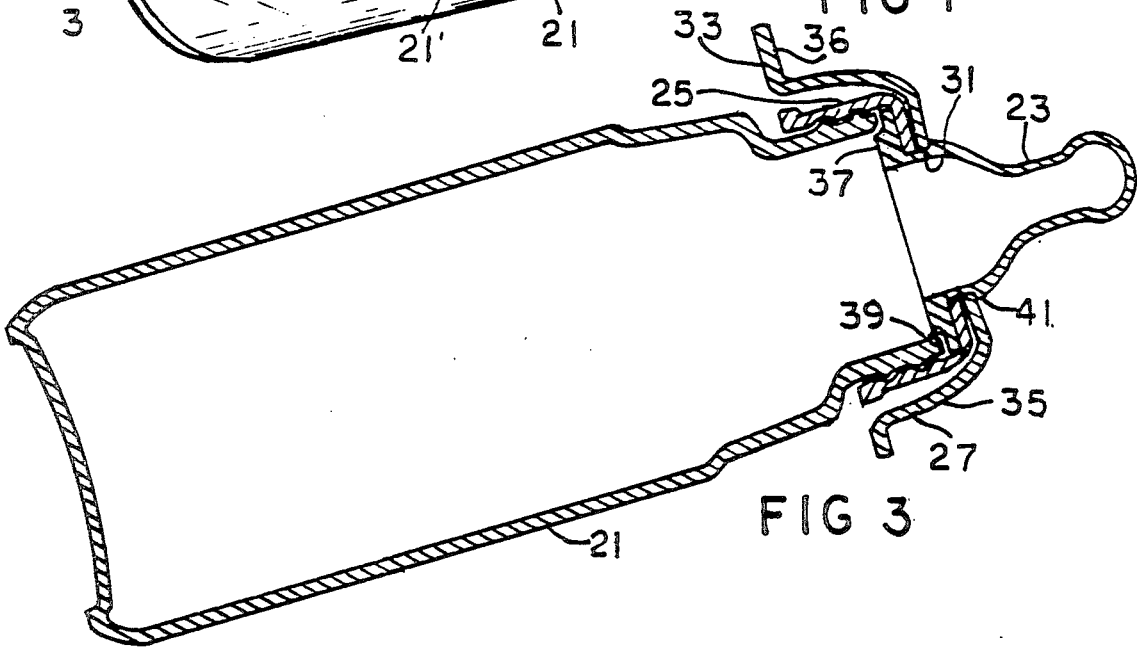
FIG. 3 is a sectional view taken along the line of 3—3 of FIG. 1.

21 bottle
21' indentations
23 nipple
25 cap
27 cover
28 cap hole edge
29 hole
31 groove
31' slots
33 decoration
34 colored circles
35 body
36 flange 37 nipple flange
39 bottle top
41 lip
43 shoulder of bottle
44 ring
45 colored laminates
45' rim
46 channel
46' space
47 rays DETAILED DESCRIPTIONS OF THE PREFERED EMBODIMENT FIG. 1 shows a perspective view of a baby feeding bottle assembly fitted with a cap, a nipple or teat, and a cap cover or rim, according to the present invention. It comprises a conventional bottle 21, a conventional rubber nipple 23, and a conventional cap or ring 25 which is screwed onto the bottle's top 39 (FIGS. 1-3). Nipple 23 has a conventional circular groove 31 (FIG. 3) formed around its lower part; This groove normally is occupied only by the edge of hole 28 in the top of cap 25.

FIG. 3 is a sectional view showing how nipple 23 has a flange 37 which is secured to the bottle top 39 by cap 25. A lip 41 on groove 31 of nipple 23 prevents a decorative cap cover 27 from coming off. Hole 29 of cover 27 fits very snugly into groove 31.

Decorative cap cover 27, according to a first embodiment of the invention, provides a decorative attachment designed to fit onto the bottle to provide amusment for the baby while it is drinking from the bottle. It comprises a cap cover 27 which is shaped like a hat, with a rim or flange 36, and it has an upper convex (when seen by the baby) body portion 35 which has a hole 29 in the center of the top portion. The diameter of hole 29 is slightly smaller than groove 31.

When cover 27 is pushed down over nipple 23 as far as it will go, hole 29 snaps into groove 31.

The cover will be held securely on the bottle by groove 31. Nipple 23 will still protrude sufficiently for the baby to suck the nipple. The cover can be held in groove 31, along with cap 25, since groove 31 is normally about 4 mm (0.156") wide, cap 25 is about 2.5 mm (0.093") thick, and cover 27 is about 1.5 mm (0.062") thick, so that cap 25 and cover 27 have a combined thickness of about the same width as groove 31. Even if the combined thickness of cap 25 and cover 27 were slightly greater than the width of groove 31, the groove could still easily accomodate both because the nipple is made of very elastic latex.

Cap cover 27 can be made of any suitable material, such as fracture-resistant plastic. Decorations 33 (FIGS. 1 and 2) can be painted on the cover's flange 36 to highlight the characters depicted in the various embodiments. Body 35 can be painted (not shown) to show, for example, a little girl's face including a smile, rosy cheeks, blue eyes, and dimples, etc., while flange 36 can be shaped and colored to represent ears, hair, hat, flowers, caps and the like.

Variations Of Cap Covers—FIGS. 4-8

Figure 4:
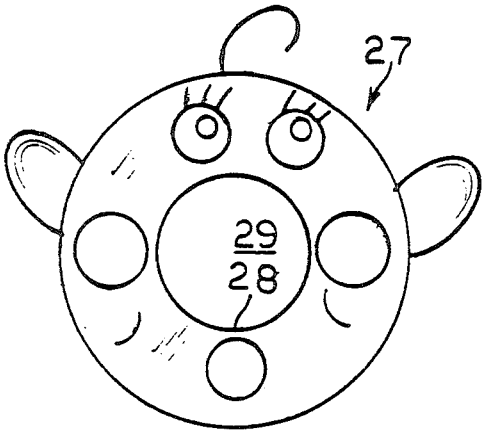
FIGS. 4 and 5 are perspective views of the cover depicting a happy little boy and clown.
Figure 5:
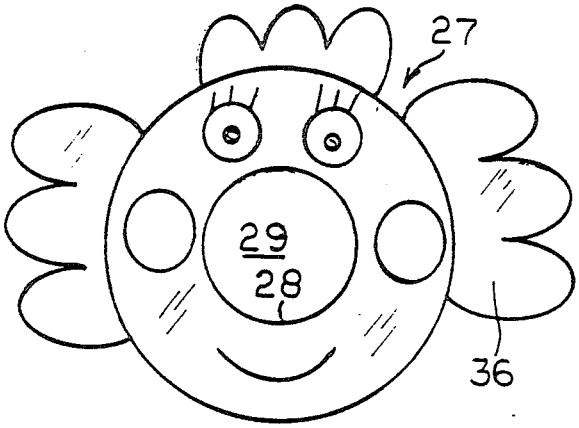
Figure 6:
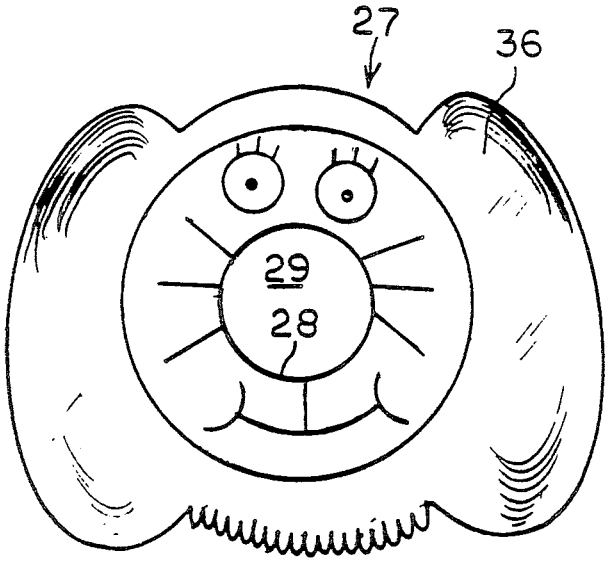
FIGS. 6–11 are perspective views depicting heads of a dog, a bear, an elephant, a cat, a rabbit, and a mouse, respectively.
Figure 7:
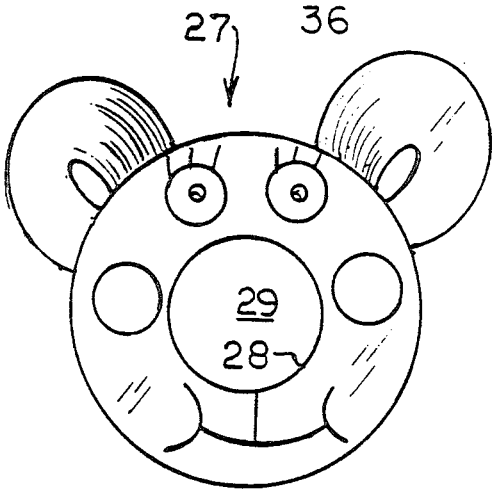
Figure 8:
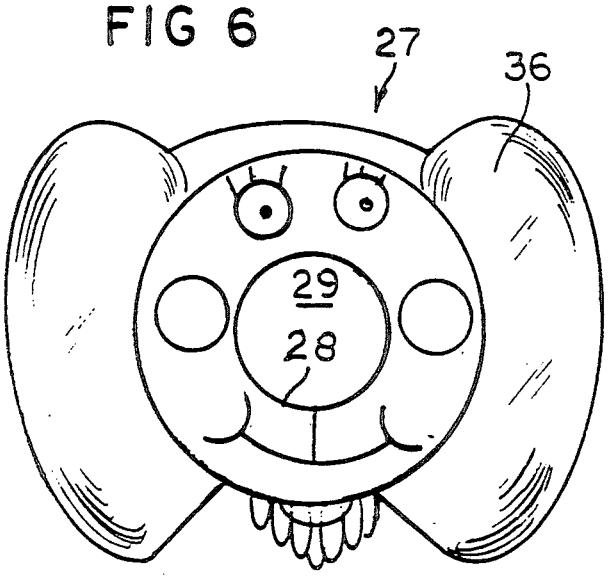
Figure 9:
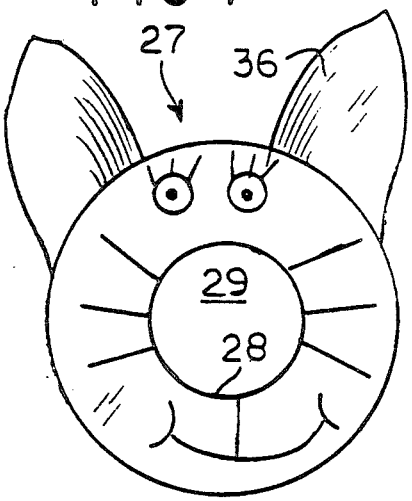
Figure 10:
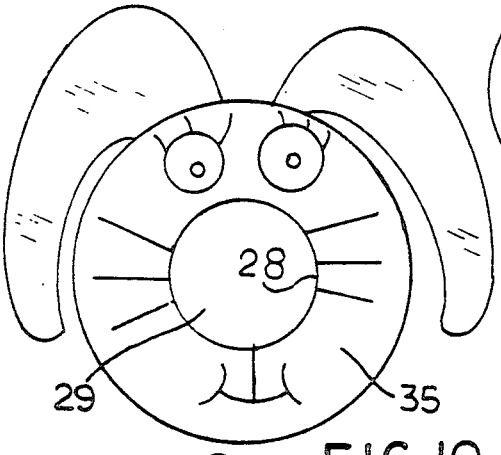
Figure 11:
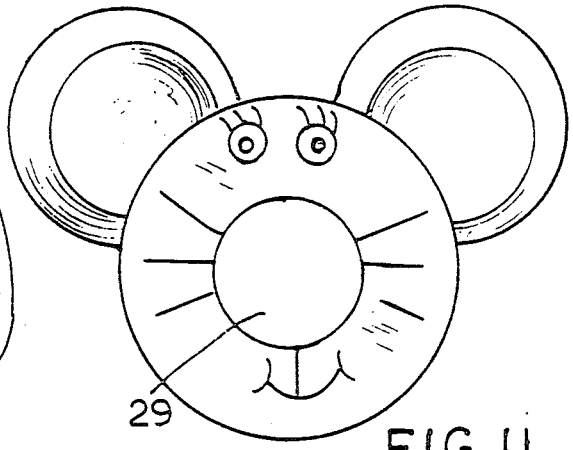

In other embodiments, as shown in FIGS. 4 and 5, flange 36 can be painted to depict a boy's hair, a clown's hair etc.

FIGS. 6-11 show various animals, namely a dog, a bear, an elephant, a cat, a rabbit, and a mouse, respectively.

Figure 12:
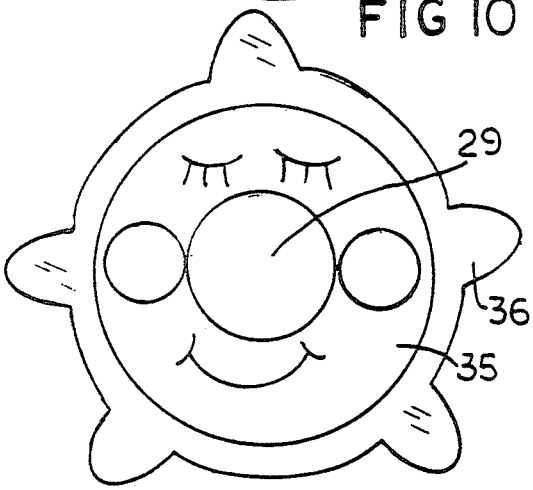
FIGS. 12–15 are perspective views depicting the image of a star, the sun, a flower, and a cap of many colors.
Figure 13:
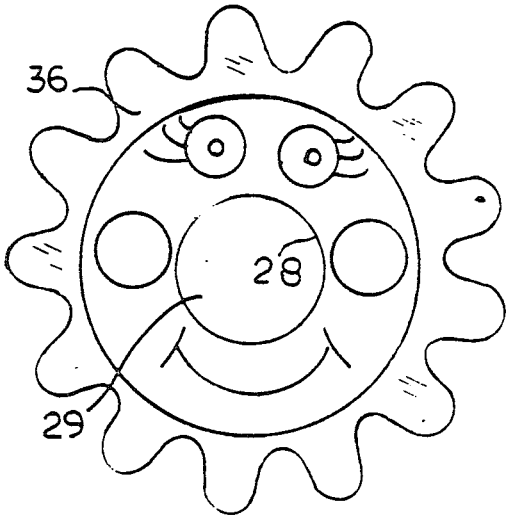
Figure 14:
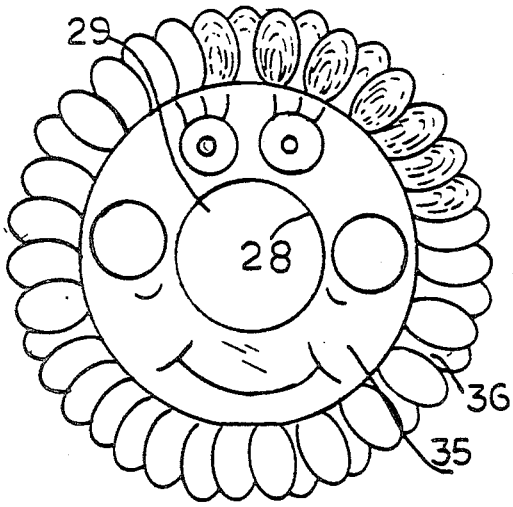
Figure 15:
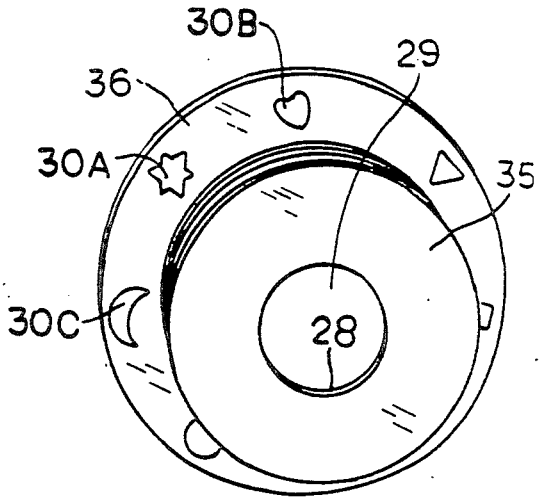

FIGS. 12-14 show a cover 27 shaped and colored to depict a face of a star, a sun, a flower, and a rainbow, respectively. Flange 36 can be also have a circular shape, or any other suitable shape, and be painted in colored circles 34 (FIG. 15) or even have additional colored paraphernalia, such as a tiny stars 30A, a heart 30B a moon 30C, or a tear drop (not shown) etc., securely attached.

Figure 16:
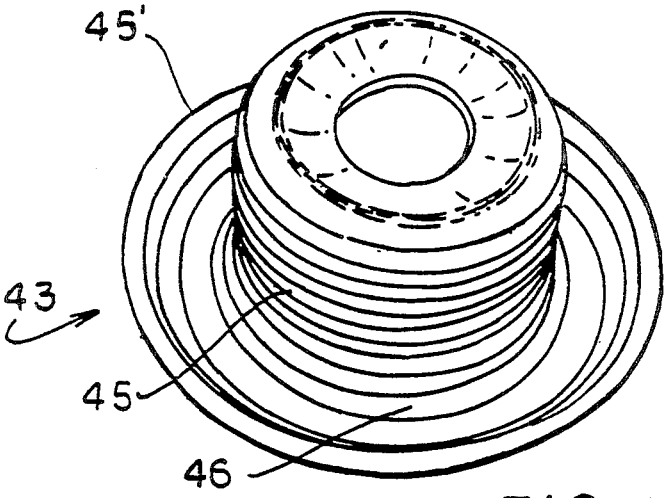
FIG. 16 is a perspective view of the cap cover according to a second embodiment showing many colored rings.

Machined Cap Cover—FIG. 16

FIG. 16 shows a second embodiment of the cover. This cover is machined from laminated arcylic 45 of different colors. It has a rim 45', and has a deep annular channel 46 which can be covered and used for accomodating musical devices (not shown) or transparent tubes which contain imitation falling snow, (not shown) to assist the baby to fall asleep. Alternatively channel 46 can contain rattles to help keep the baby awake.

Figure 17:
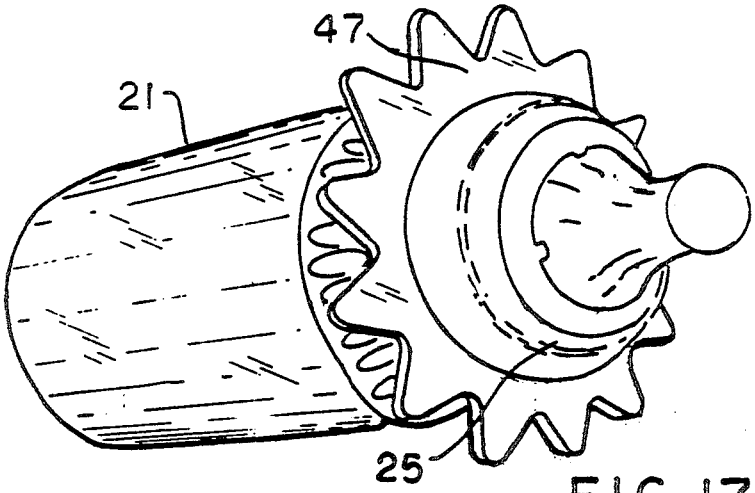
FIG. 17 is a perspective view of a third embodiment in which a screw-down cap and cover are combined.

Integral Screw—down cap and Rim—FIG. 17

FIG. 17 shows a third embodiment in which rim portion 47 is made integral with screw-down cap 25, and can be made in any shape or color such as those of the sun and rays, or any other colors and shapes (nor shown).

Figure 18:
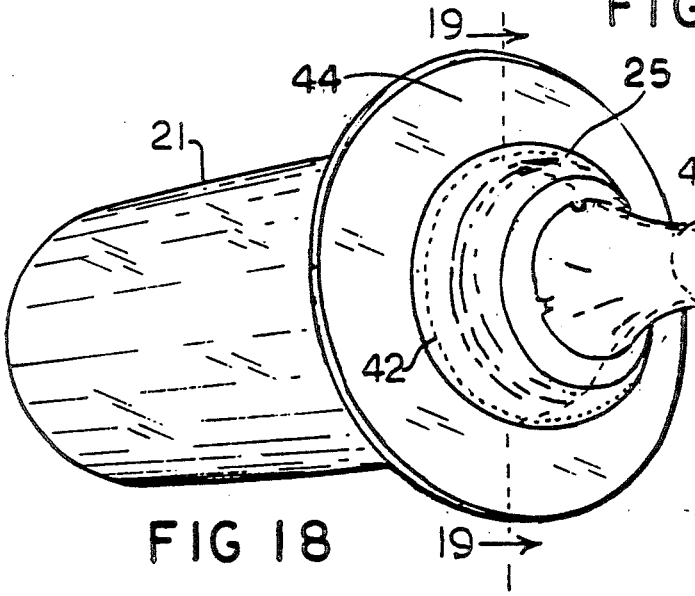
FIG. 18 shows a separate ring embodiment used in conjunction with the screw-down cap.
Figure 19:
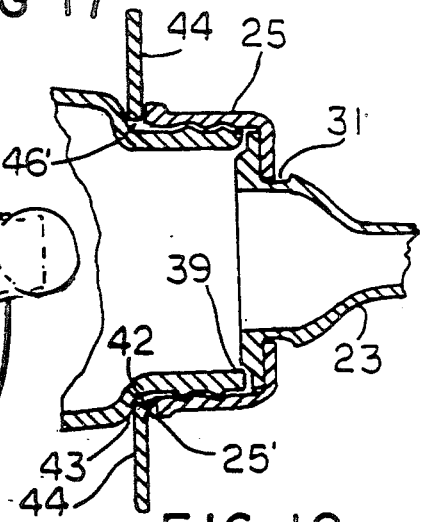
FIG. 19 is a sectional view of 19—19 taken along line FIG. 18.

Separate Rim Embodiment—FIGS. 18 and 19

FIG. 18 shows a separate ring 44 which can be assembled over the bottle's neck and against shoulder 43 prior to fitting screw-down cap 25. Ring 44 can be suitably decorated (not shown) and made in any shape with baby-amusing paraphernalia attached.

The diameter of hole 42 (FIGS. 18 and 19) is made slightly larger than the outside diameter of top 39 but smaller than the outside diameter of base 25' (FIG. 19). Thus ring 44 will be secured in space 46' between shoulder 43 and base 25' of the cap.

Air-bleed Valves Unaffected in All Embodiment—(FIG. 1-3)

Slots 31', (FIGS. 1-3) provide conventional air ducts to non-return valves (not shown) made integral with the latex bottle's nipple. These allow air to enter the bottle to replace milk sucked from the bottle by the child, and at the same time prevent milk leakage from the bottle when it is inverted during feeding. Alternatively, the bottle can have an internal fluid-holding bag which collapses when the milk is withdrawn and where the bottle has a vent to supply air in the space around the bag as it collapses.

A ring of indentations 21' provides hand grips on bottle 21 to assist in tightenting cap 27.

After the bottle has been filled with milk or the like to feed the baby, cap cover 27 is pushed over the nipple and down as far as it will go. It will come in contact with cap 25 and its hole 29 will snap into groove 31 of nipple 23. This securely holds the cover against any attempt by the baby to remove it.

The body part represents a face which protrudes forward of the hairline, ears and hat etc, while the nipple or teat represents the nose which is the most forward part of the face.

The flange part represents ears, hair, hat, etc. and any background features which can be drawn or made integrally with it.

From a baby's position while sucking the nipple, he or she is able to see the ears, hair, hat and background features more easily than the facial features, which will be much closer to the baby's lips. Thus the baby will get amusment from these features and their colors. The baby also can withdraw the nipple from its mouth from time to time and get amusment from looking at the whole face from a more suitable distance. The overall shape of the cap cover, nipple, and flange is more representative of a nose, face, hair and ears than it would be if for instance just a flat disc were attached to the groove around the nipple, even with features painted thereon. Also it is more difficult for a baby to remove the cover because the body part goes down and around the screw-down cap with a minimum of tolerance, thus making it more difficult to twist or angle the cover.

The baby is able to see and be entertained by the colors and characters on the cap cover. This will assist, not only providing amusment for the baby, but in providing a means for keeping baby awake until it has finished drinking.

A new field of amusment and entertainment for a baby and/or child is provided by the use of the attachment. Also, it provides a device with which a mother, a nurse, or baby sitter can talk about, entertain, or even use to teach a child. Further the various elements of the attachment can be used to advantage when a child is ill and needs coaxing with its food-taking. This is done by telling the child that the animals depicted all drink their milk, are happy, etc. The attachment in many ways can thus help to solve feeding problems that have not previously been addressed by plain prior-art bottles.

When ring 44 (FIG. 18) is fitted onto the neck of bottle 21 followed by screw-down cap 25, the baby can see any characters on cap 25, as well as those on ring. It will be realized that when a cap bearing the face of a dog is combined with a ring showing the hair of a little girl and a hair-tie ribbon, many odd entertaining faces and features can be combined, thus enhancing the advantages of the attachment.

An additional use of the attachment is in its application on toy baby bottles, such that children, particularly girls, can pretend being mothers and feed their toy dolls. A cap cover thus becomes not only a toy baby bottle attachment, but a teaching item pertaining to colors, faces, animals, designs etc.

SUMMARY, RAMIFICATIONS, AND SCOPE

Thus, the reader will see that I have provided a cap cover for a baby bottle which is not only entertaining for the baby, but is a delight for the mother as well. Also additional attachments can be fitted to provide limited music, or scenes akin to falling snow, or sea wave action, etc. The cap cover can assist the baby in holding onto the bottle and directing the nipple into its mouth.

Furthermore, while the attachment is to provide amusment for the baby during its bottle feeding stage, it can double as a toy after the child no longer feeds from a bottle. As the child grows still older, the cover, when made in miniature, can be fitted to toy baby bottles so that the child now learns to prepare bottles for dolls. Thus training to handle babies becomes a natural part of the child's life.

While the above description contains many specificities, the reader should not construe these as limitations on the scope of the invention, but merely as exemplifications of preferred embodiments thereof. Those skilled in the art will envision that many other possible varations are within its scope. For example, skilled artisans will readily be able to change the dimensions and shapes of the various embodiments, such as by making the decorative cover different in shape or texture or color, or material, or relating it to a different field of amusment. As the variety of interesting features that can be portrayed is limitless, myriad variations and other embodiments will occur to those skilled in the art. It is even possible to include miniature lighting, scenery, music, etc.

Accordingly, the reader is requested to determine the scope of the invention by the appended claims and their legal equivalents, and not by the examples which have been given.

I claim:

1. A baby bottle assembly of the type comprising:

a bottle having an open mouth and attachment means around said mouth for enabling a nipple-holding cap ring to be attached to said mouth, a flexible, stretchable nipple having an elongated teat, said teat having a base, a flange extending from said base and shaped and dimensioned to mate with said mouth of said bottle, and a groove around said base of said teat at the junction of said teat with said flange, and a nipple-holding cap ring, said cap ring including coupling means which is coupled to said attachment means around said mouth of said bottle, said cap ring having an opening through which said teat is inserted so that said ring is coupled to said bottle and said teat is inserted through said opening, said cap ring mating with said groove in said base of said teat and clamping said flange of said nipple against said mouth of said bottle,

*an improvement comprising* a decorative ring comprising a thin annular member with a body part which is convex when seen from a front side thereof and concave when seen from a back side thereof, said body part of said decorative ring having a center opening which is sized to mate with said groove in said base of said teat, such that said center opening can be pushed down over said teat and snapped into said groove, and opening of said decorative ring mating with and engaging said groove, and, said body part of said decorative ring being shaped so that when said opening of said decorative ring mates with said groove with said back, concave side of said decorative ring facing said bottle and said convex side facing said teat, said body part will extend over and cover said cap ring, said body part of said decorative ring having a base portion remote from said center opening, said decorative ring having a flange extending out from said base portion of said body part, such that when said decorative ring is snapped into said groove with said concave side of said decorative ring facing said bottle, said flange will be spaced away from said teat so that a baby feeding from said teat can see said flange and so that said flange will not interfere with said baby feeding from said nipple, said flange having decorations thereon for amusing said baby when it feeds from said bottle.

2. The decorative ring of claim 1 wherein said body part of said decorative ring has decorations which are complementary to said flange of said decorative ring.

3. The decorative ring of claim 1 wherein said body part of said decorative ring has a face image thereon and said flange of said decorative ring is decorated to complement to said face image, the decorative shape of said flange of said decorative ring being selected from the class consisting of simulated hair, ears, and rays.

4. The decorative ring of claim 1 wherein said decorations on said flange of said decorative ring comprise multiple colors.

5. The decorative ring of claim 1 wherein said flange of said decorative ring has an outer edge which comprises scallop-shaped decorations.

* * * * *